United States Patent [19]

Van Rens et al.

[11] Patent Number: 4,868,453

[45] Date of Patent: Sep. 19, 1989

[54] COLOR DISPLAY TUBE HAVING A MULTI-PART SUSPENSION MEANS FOR A COLOR SELECTION ELECTRODE AND METHOD OF MANUFACTURING SAME

[75] Inventors: Piet C. J. Van Rens; Henricus J. M. Van Der Avoort; Hans G. Kieschke, all of Eindhoven, Netherlands

[73] Assignee: U.S. Philips Corporation, New York, N.Y.

[21] Appl. No.: 184,844

[22] Filed: Apr. 25, 1988

[30] Foreign Application Priority Data

Apr. 27, 1987 [NL] Netherlands ..... 8700984

[51] Int. Cl.[4] ..... H01J 29/82

[52] U.S. Cl. ..... 313/402; 313/406; 445/30; 445/37

[58] Field of Search ..... 313/402, 404, 405, 406; 445/30, 37

[56] References Cited

U.S. PATENT DOCUMENTS

| | | | |
|---|---|---|---|
| 2,905,846 | 9/1959 | Chapman et al. | 313/406 |
| 2,922,063 | 1/1960 | Haas | 313/406 |
| 4,644,222 | 2/1987 | Brunn | 313/406 |
| 4,763,039 | 8/1988 | Van Rens et al. | 313/406 |

*Primary Examiner*—Donald J. Yusko
*Assistant Examiner*—Sandra L. O'Shea
*Attorney, Agent, or Firm*—John C. Fox

[57] ABSTRACT

Means for suspending a color selection electrode from the display window of a color display tube, the means consisting of a first element which is connected to the color selection electrode, and a two-part second element connected to the display window. The second element consists of two separately made parts, a head and a base, enabling manufacture and placement of the head with a high degree of accuracy, and resulting in improved insertion reproducibility of the color selection.

4 Claims, 4 Drawing Sheets

COLOR DISPLAY TUBE HAVING A MULTI-PART SUSPENSION MEANS FOR A COLOR SELECTION ELECTRODE AND METHOD OF MANUFACTURING SAME

BACKGROUND OF THE INVENTION

The invention relates to a colour display tube comprising an envelope including a display window, a colour selection electrode, and suspension means for suspending the colour selection electrode from the display window, which suspension means each comprise a first element which is secured to the colour selection electrode and a second element which is secured to the display window, the first element having an aperture and the second element having a portion which engages the said aperture.

A colour display tube of the type described in the opening paragraph, having suspension means in the vicinity of the four corners of a substantially rectangular display window is known from U.S. Pat. No. 4,644,222.

In the colour display tube described therein, the first element of each suspension means is a flat resilient element which is oriented substantially perpendicular to the path of electron beams to be deflected to the relevant corner, and the second element is a metal pin which is secured at one end to the corner of an upright edge of the display window and at the other (free) end has a convex portion. This pin is made in one piece of tinplate or moulded or turned from a rod-like metal body.

An important aspect of the suspension of the colour selection electrode is the dimensional accuracy with which the said (convex) portion of the second element of each suspension means engages the aperture of the first element. The color selection electrode is used in the photographic process of providing a display screen on the display window, repeated mounting and demounting of the colour selection electrode is necessary. In this process the insertion reproducibility, i.e. the degree of reproducibility of the location of the colour selection electrode is very important. This insertion reproducibility is influenced by the accuracy with which the (convex) portion and the of this portion of the second element of each suspension means is made.

SUMMARY OF THE INVENTION

Consequently, it is an object of the invention to provide a means of increasing the insertion reproducibility of the colour selection electrode.

This object is achieved by a colour display tube of the type mentioned in the opening paragraph, which is characterized according to the invention in that the second element of each suspension means comprises at least two separately made parts, the first part being connected to the display window and the second part for engaging the aperture of the first element of the suspension means.

The first part of the second element of the suspension means will hereinafter be referred to as "the base", the second part will be referred to as "the head".

The insight on which the invention is based is that dependent upon the manner of interconnecting, the demands imposed on the base and on the head are different, and since the parts are manufactured separately, different requirements may be met for each of the parts. Thus, it is possible to manufacture the head with a very high dimensional accuracy without it being necessary to produce the entire second element with the same dimensional accuracy. In this way a very high insertion reproducibility of the colour selection electrode can be obtained readily.

Furthermore, the base may be specially processed. For example, in the case of sealing the base partly into the display window, it may be advantageous to roughen the surface of the base.

In a preferred embodiment of a colour display tube according to the invention, the second part is a substantially spherical member. Spherical members having a high dimensional accuracy, a high degree of reproducibility and a very accurate surface can be made readily. Also, the spherical shape has the highest symmetry. Consequently, the orientation of a spherical head relative to the base does not influence the dimensional accuracy with which the head engages the aperture of the first element. Errors caused by deviations in the orientation of the head relative to the base can thus be avoided.

In a further preferred embodiment of the colour display tube according to the invention, the first part consists of a material having a coefficient of expansion which is at least substantially equal to the coefficient of expansion of the material of which the display window is made.

Closely matching the coefficients of thermal expansion of the display window and the base minimizes thermal stresses which may lead to cracking, and minimizes changes in the position of the base as a function of temperature or time, or in the display window, which are caused by the difference in the coefficients of thermal expansion. Due to these thereby reducing or substantially avoiding changes in the position of the shadow mask which would reduce picture quality.

In yet another preferred embodiment of the colour display tube according to the invention, the second part is made of a corrosion-resistant material, thereby reducing corrosion of the surface of the head, which leads to a reduced insertion reproducibility.

The invention also relates to a method of manufacturing a colour display tube of the type described hereinbefore, which method is characterized in that the first and the second part of each suspension means are connected to each other after the first part has been connected to the display window.

The risk that the head is damaged can thereby be reduced; moreover, even when the position of the base connected to the display window deviates from the desired position this can be compensated to a certain extent when the head is connected to the base. The insertion reproducibility can thus be improved and the number of rejects decreased.

BRIEF DESCRIPTION OF DRAWINGS

The invention will now be explained in more detail with reference to a few embodiments and a drawing, in which.

DESCRIPTION OF THE PREFERRED EMBODIMENTS

Figure 1:
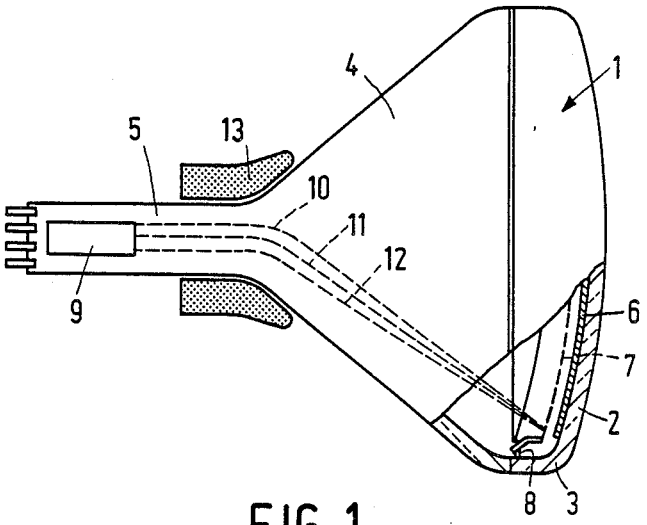
FIG. 1 is a partly sectional schematic view of a colour display tube according to the invention.

FIG. 1 is a sectional view of a colour display tube according to the invention. The colour display tube comprises an envelope 1 having a substantially rectangular display window 2 with an upright edge 3, a cone 4 and a neck 5. A pattern of phosphors 6 luminescing in red, green and blue is provided on the display window 2.

A substantially rectangular colour selection electrode 7 having a great number of apertures is suspended at a short distance from the display window 2 by means of suspension mean 8 near the corners of the said upright edge 3.

An electron gun 9 for generating three electron beams 10, 11 and 12 is mounted in the neck 5 of the colour display tube. These beams are deflected by a coil system 13 and intersect substantially at the location of the colour selection electrode 7, after which each of the electron beams impinges on one of the three phospors provided on the screen.

In the present embodiment each suspension means 8 comprises a first element which is secured to the colour selection electrode and which, is a plate-shaped resilient element which extends perpendicularly to the path of the deflected electron beams 10, 11 and 12 in the relevant corner, and a second element which is secured near the corner of the upright edge 3 of the display window 2.

Figure 2:
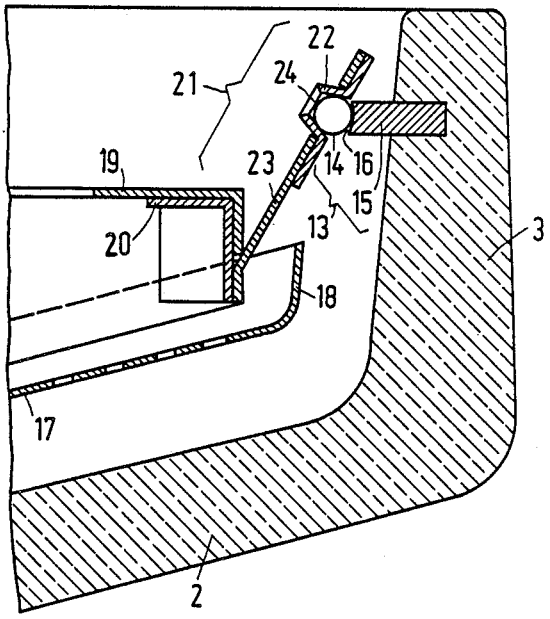
FIG. 2 is a sectional detailed view of one embodiment of the suspension means of a colour display tube according to the invention.

FIG. 2 is a sectional detailed view of the colour display tube shown in FIG. 1. The second element 13 of the suspension means 8 is sealed to and extends perpendicularly from the edge 3 of the display window 2. This second element 13 comprises a head 14 and a base 15, interconnected by a connection 16. The colour selection electrode 7 consists of a thin mask blank 17 in which many apertures are provided, and which has an upright frame 18. A mask edge 19 is secured to the upright edge 18. A support strip 20 is secured to the corner of the mask frame 19. The first element of the suspension means is a flat resilient element 21, secured to this support strip 20. The flat resilient element 21 is at an angle with the longitudinal axis of the colour display tube, such that it extends substantially perpendicularly to the path of the deflected electron beams 10, 11 and 12 in the relevant corner of the display window 2. The the flat resilient element 21 contains a part 22 which is partly formed as a hollow cone, and which is secured to a mainly flat part 23. The part 22 comprises an aperture 24 with which the head 14 of the second element 13 engages. It will be clear that within the scope of the invention many variations of the shape of the first element shown are possible for example a first element as shown and described in GB No. 2,097,996 A, in which the first element consists of two parts which are interconnected by a spring, is also suitable.

Figure 3:
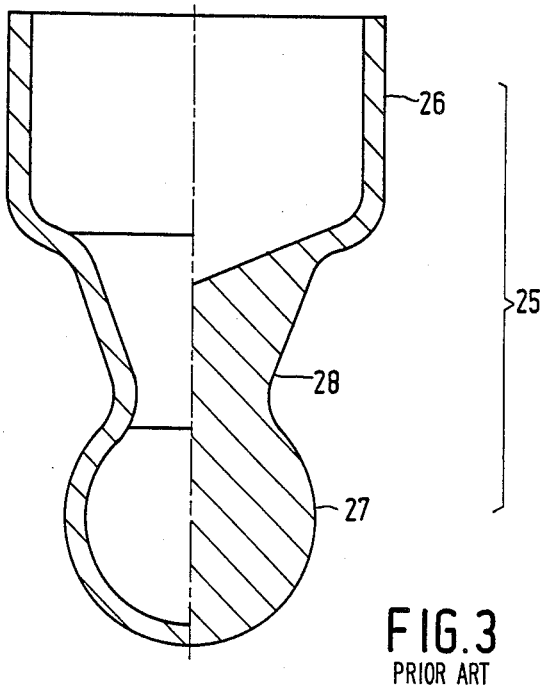
FIG.3 PRIOR ART
FIG. 3 is a sectional view of a second element of the suspension means, according to the prior art.

FIG. 3 shows a second element 25 of the suspension means of the prior art, as known from EP-A No. 2-0156362. This element consists of a bottom portion 26, a convex portion 27 which engages an aperture in a first element of the suspension means, not shown, and a neck 28. This second element 25 is a metal member which is manufactured in one piece. It consists of tinplate or it is turned or moulded from a rod-like metal body. The left half of this drawing is a sectional view of a second element which is made of tinplate, the right half is a sectional view of a second element which is turned from a rod-like metal body. Deviations which may adversely affect the insertion reproducibility of the colour selection electrode include deviations from the spherical shape of the convex portion 27, as well as irregularities in the surface of the convex portion 27, for example corrugations which may be formed during the turning of a rod-like body to form the second element 25.

Figure 4:
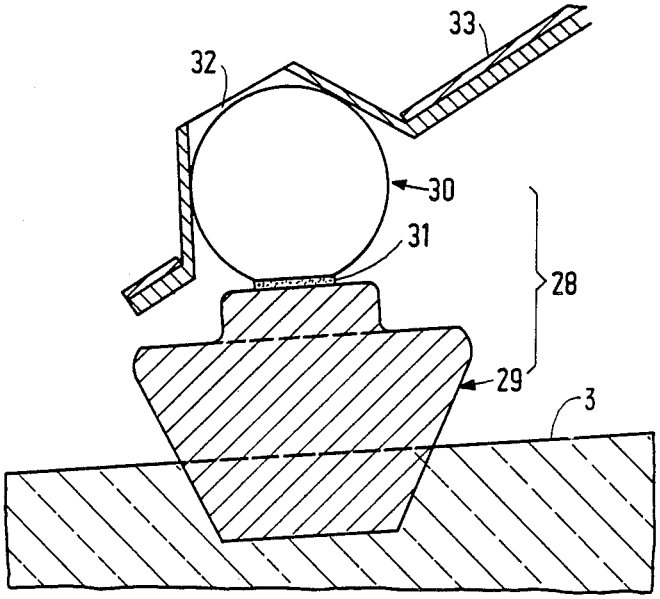
FIG. 4 is a sectional view of another embodiment of a second element of the suspension means according to the invention.

FIG. 4 is a sectional view of another embodiment of a second element 28 of the suspension means which is suitable for use in a colour display tube according to the invention. In this embodiment, the second element 28 consists of a base 29, a convex head 30, interconnected by a connection 31. The head 30 engages the aperture 32 of the first element 33 of the suspension means.

Because head 30 is manufactured separately from base 29, it can be manufactured with a much greater degree of accuracy than the spherical end 27 shown in FIG. 3. The degree of accuracy with which the head 30 engages in aperture 32 of the first element 33 is thus increased and, consequently, the insertion reproducibility of the selection electrode connected to this first element is also increased. The base 29 may be manufactured with a much smaller degree of accuracy.

Other shapes may be used for the head 30, for example a conical shape. However, the spherical shape has the advantage relative to other shapes that the rotational orientation of the head 30 relative to the base 29 is not critical.

The parts 29 and 30 of the second element 28 of the suspension means may be made of different materials. They may also be made of the same material. One or both parts may be made of, for example, metal, metal alloy, synthetic resin, glass or ceramics.

The parts 29 and 30 may be interconnected in any way suitable. Connection 31 may be achieved by, for example, resistance welding, laser welding, ultrasonic welding, thermocompression bonding, or bonding by means of an adhesive, cement or enamel. The base 29 is secured to the display window 2 by sealing it into the upright edge 3 of the display window. Many other methods of connecting the base to the display window may be used, for example, thermocompression bonding or ultrasonic welding. coefficient of expansion is at least substantially equal to the coefficient of expansion of the material used for the display window. Problems, such as those described above, which may occur due to difference in the coefficients of thermal expansion of the base and the display window are then avoided as much as possible. The base may be made of, for example, steel of the type N 1048 or of the type N 691.

Preferably, the head 30 consists of a corrosion-resistant material. Corrosion may damage the surface of the head 30, which leads to a reduced insertion reproducibility of the colour selection electrode. The head may be made of, for example, steel of the type N 1201.

FIGS. 5, 6, 7, 8 and 9 are sectional views of further embodiments of a second element of the suspension means which is suitable for use in a colour display tube according to the invention.

Figure 5:
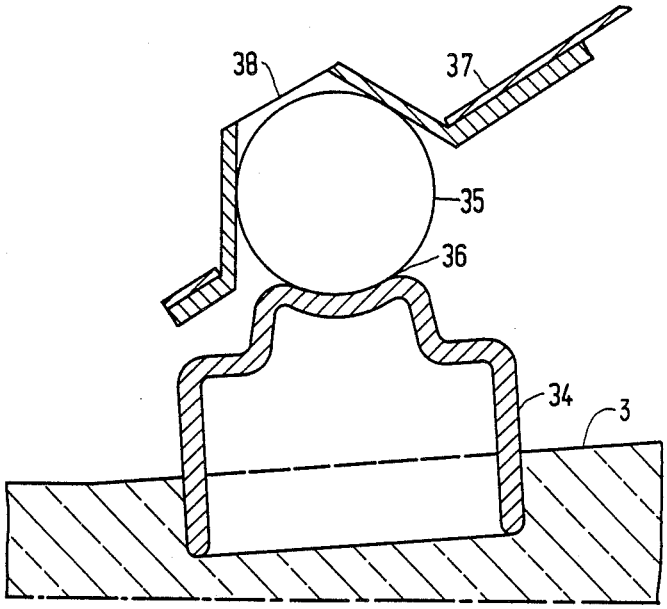
FIGS. 5, 6, 7, 8 and 9 are sectional views of further embodiments of a second element of the suspension means according to the invention.

In FIG. 5, one end of a hollow base 34 is sealed into upright edge of display window 3, and the other free end is connected to the head 35 by means of connection 36. This head 35 engages in the aperture 38 of the first element 37 of the suspension means.

Figure 6:
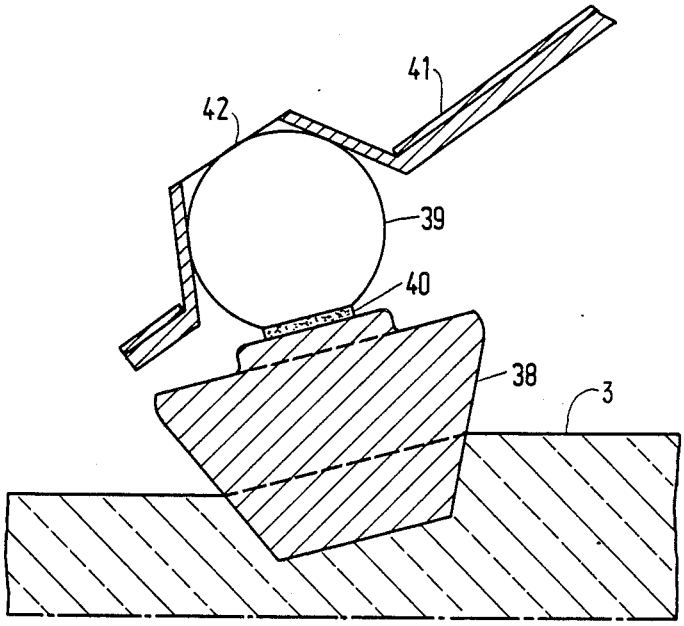
Figure 7:
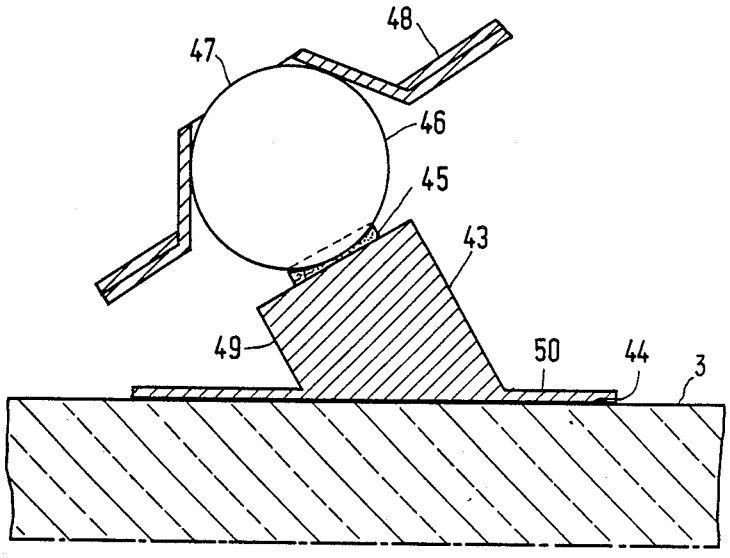

In FIG. 6 a solid base 38 is sealed into the upright edge 3 of the display window 2 at a predetermined angle. The solid base 38 is connected to the head 39 by means of connection 40. This head 39 engages in the aperture 42 of the first element 41 of the suspension means. In FIG. 7 the base 43 consisting of a solid cylinder 49 having a flange 50 which forms an acute angle with this cylinder, is connected to the upright edge 3 of the display window 2 by means of thermocompression bonding using a metal connection layer 44.

Thermocompression bonding is a method in which the metal of the connection layer is plastically deformed in contact with the glass, at an elevated temperature, but below the softening temperature of the glass. This method is described, for example, in American Ceramics Society Bulletin, volume 51, No. 9, page 683 (1972). The base 43 is connected to the head 46 by means of connection 45. The head 46 engages the aperture 47 of the first element 48 of the suspension means.

Figure 8:
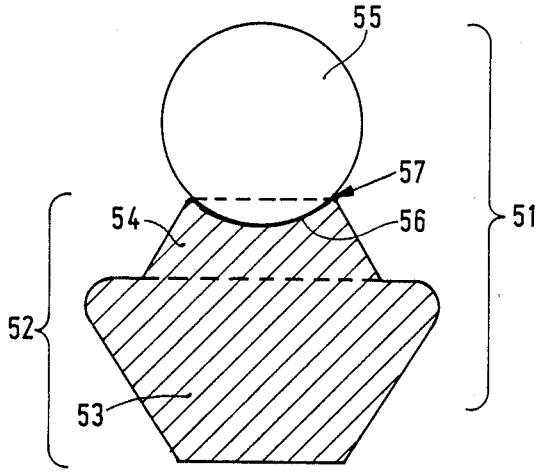

FIG. 8 is a sectional view of a second element 51 of the suspension means of the invention, consisting of a solid base 52 and a head 55. The base 52 consists of a support 53 and a neck 54. The head 55 lies against the surface 56 of the neck 54 and is connected to the base 52 by means of the connection 57.

Figure 9:
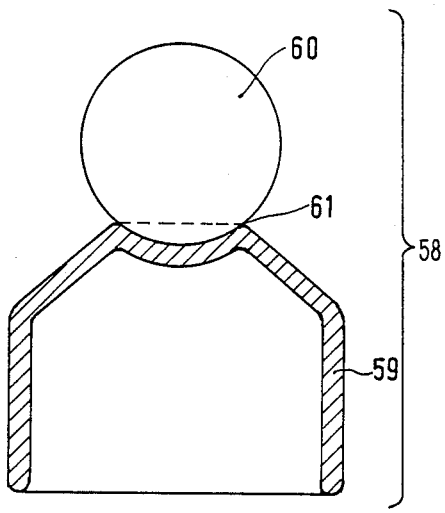

FIG. 9 shows a second element 58 of the suspension means of the invention, consisting of a base 59 and a head 60, which are interconnected by means of a connection 61. In this example, the base consists of a bracket.

The connections 36, 40 and 45 shown in FIGS. 5, 6, 7, 8 and 9 may be formed in any suitable way, for example, as described hereinbefore.

What is claimed is:

1. A colour display tube comprising a display window, a colour selection electrode and a plurality of suspension means for suspending the colour selection electrode from the display window, each suspension means comprising a first element which is secured to the colour selection electrode and a second element which is secured to the display window, the first element having an aperture, and the second element having a portion which engages the aperture, the second element of each suspension means comprising at least two separately made parts, the first part being connected to the display window and the second part engaging the aperture of the first element, characterized in that the second part is a substantially spherical member.

2. A colour display tube as claimed in claim 1, in which the first part consists of a material whose coefficient of expansion is at least substantially equal to the coefficient of expansion of the material of which the display window is made.

3. A colour display tube as claimed in claim 1, in which the second part consists of a corrosion-resistant material.

4. A method of manufacturing a colour display tube comprising a display window, a color selection electrode and a plurality of suspension means for suspending the color selection electrode from the display window, each suspension means comprising a first element which is secured to the color selection electrode and a second element which is secured to the display window, the first element having an aperture and the second element having a portion which engages the aperture, the second element of each suspension means comprising at least two separately made parts, the first part being connected to the display window and the second part engaging the aperture, characterized in that the first part of each suspension means is connected to the display window, after which the first and the second parts are connected to each other.

* * * * *